United States Patent [19]

Cody

[11] Patent Number: 5,011,106

[45] Date of Patent: Apr. 30, 1991

[54] ROOF SAFETY ANCHOR

[75] Inventor: Parvaneh Cody, Don Mills, Canada

[73] Assignee: Stanford Cody Limited, Woodbridge, Canada

[21] Appl. No.: 499,966

[22] Filed: Mar. 27, 1990

[51] Int. Cl.[5] ..... A62B 35/02; A62B 37/00

[52] U.S. Cl. ..... 248/237; 182/3; 182/45

[58] Field of Search ..... 248/237; 24/115 K, 265 CD; 410/101; 182/45, 3

[56] References Cited

U.S. PATENT DOCUMENTS

| | | | |
|---|---|---|---|
| 3,297,293 | 1/1967 | Andrews | 24/115 K |
| 3,888,190 | 6/1975 | Bigge | 410/101 |
| 4,249,713 | 2/1981 | Glynn | 248/237 |
| 4,369,010 | 1/1983 | Ichinose | 410/101 |
| 4,606,430 | 8/1986 | Roby | 182/3 |
| 4,634,325 | 1/1987 | Williams | 410/101 |
| 4,852,692 | 8/1989 | Flaherty | 248/237 |
| 4,928,790 | 5/1990 | Franks | 182/3 |

*Primary Examiner*—Reinaldo P. Machado

[57] ABSTRACT

The present invention is directed to a safety anchor for mounting on the roof of a building. The safety anchor comprises an anchor member and a base for supporting the anchor member. The anchor member is provided with a closed loop extending from the base for attachment of the safety line and an elongate securing member in contact with the surface of the base. The anchor member is attached to the base by a plurality of points of attachment between the elongate securing member and the surface of the base. In a preferred embodiment of the invention, the anchor member is a U-shaped member securely attached to the base by a plurality of points of attachment between the arms of the anchor member and the surface of the base. The closed loop extending from the base is defined by the interior periphery of the anchor member extending from the base and the exterior periphery of the base between the arms of the anchor member. The safety anchor of the present invention provides for a secure anchor means for attachment of safety ropes, the elongate securing member of the anchor member resulting in the safety anchor having high tensile strength and high resistance to lateral and shear forces.

10 Claims, 4 Drawing Sheets

ROOF SAFETY ANCHOR

FIELD OF THE INVENTION

The present invention relates to safety anchors for mounting on the roof top and wall of a building, in particular, on the roof of a high rise building or the like, to provide means for attachment of safety lines and other support lines.

BACKGROUND OF THE INVENTION

When workers are working on the outside of buildings and in particular, high rise buildings, for maintenance of the building such as for example, washing of the windows, such workers typically employ swing stages. As a back up for such swing stages should the primary suspension lines fail, the workers and sometimes the stages are provided with secondary anchor lines. These anchor lines, which are generally slack, must be securely attached to the building by a means which will withstand the forces which may be applied to them should they be required to suddenly support the worker or swing stage upon failure of the primary suspension lines. Such forces include tensile, lateral and shear forces. In the past, these safety lines have been attached to any convenient structure on the roof around which a rope may be attached. Depending upon the structure, such structure may not be able to withstand the forces placed upon it when needed to support the safety line.

Eyebolt anchors have been provided on the roof or walls of. high-rise buildings for attachment of safety ropes. While such eyebolt anchors have adequate tensile strength, they are relatively poor in terms of resistance to lateral or shear forces which may act upon them. Thus, when such a safety anchor is subjected to such forces, failure of the anchor may occur.

SUMMARY OF THE INVENTION

The present invention is directed to a safety anchor for mounting on the roof top or wall of a building. The safety anchor comprises an anchor member and a base for supporting the anchor member. The anchor member is provided with a closed loop extending from the base for attachment of the safety line and an elongate securing member in contact with the surface of the base. The anchor member is attached to the base by a plurality of points of attachment between the elongate securing member and the surface of the base.

In an aspect of the invention, the anchor member is a U-shaped member securely attached to the base by a plurality of points of attachment between the arms of the anchor member and the surface of the base. The closed loop extending from the base is defined by the interior periphery of the anchor member extending from the base and the exterior periphery of the base between the arms of the anchor member.

In another aspect of the invention, the anchor member is a C-shaped member providing for two closed loops extending from either side of the base.

The safety anchor of the present invention provides for a secure anchor means for attachment of safety ropes, the elongate securing member of the anchor member resulting in this connection within the safety anchor having high tensile strength and high resistance to lateral and shear forces.

BRIEF DESCRIPTION OF THE DRAWINGS

The above as well as other advantages of the present invention will be appreciated from drawings which illustrate preferred embodiments of the invention in which.

DETAILED DESCRIPTION OF THE PREFERRED EMBODIMENTS

Figure 1:
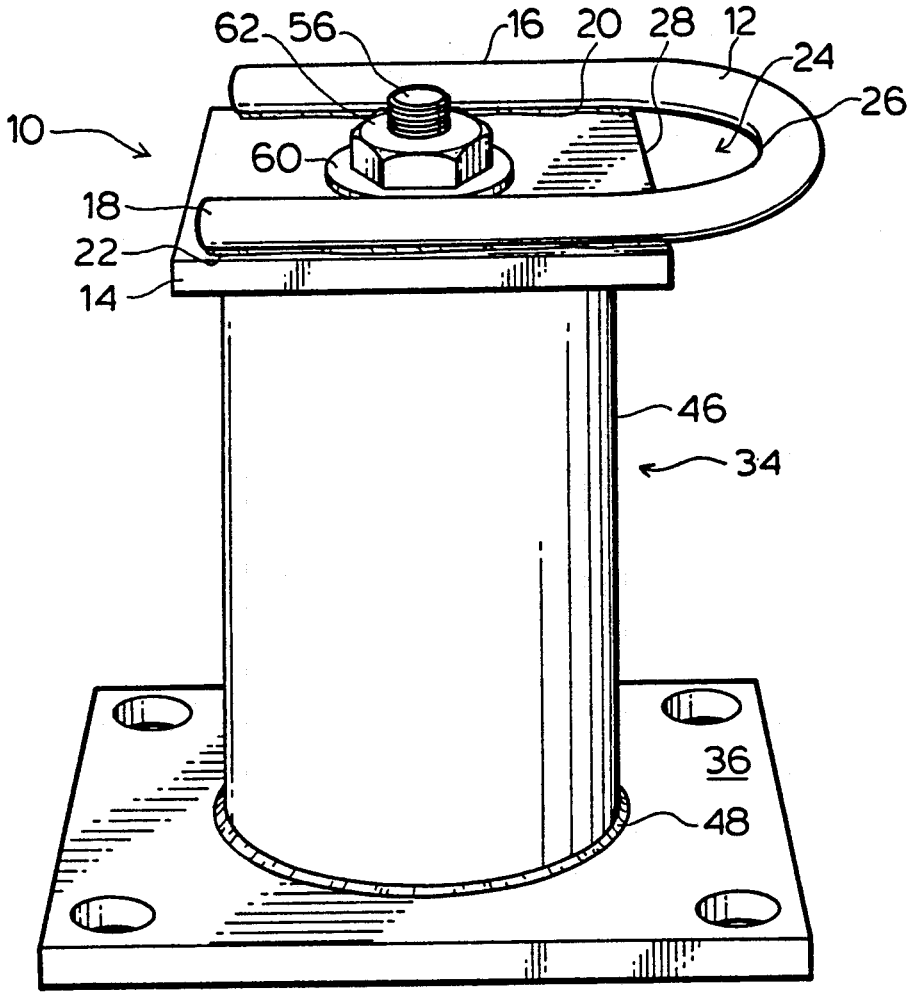
FIG. 1 is a perspective view of one embodiment of the safety anchor of the present invention.
Figure 2:
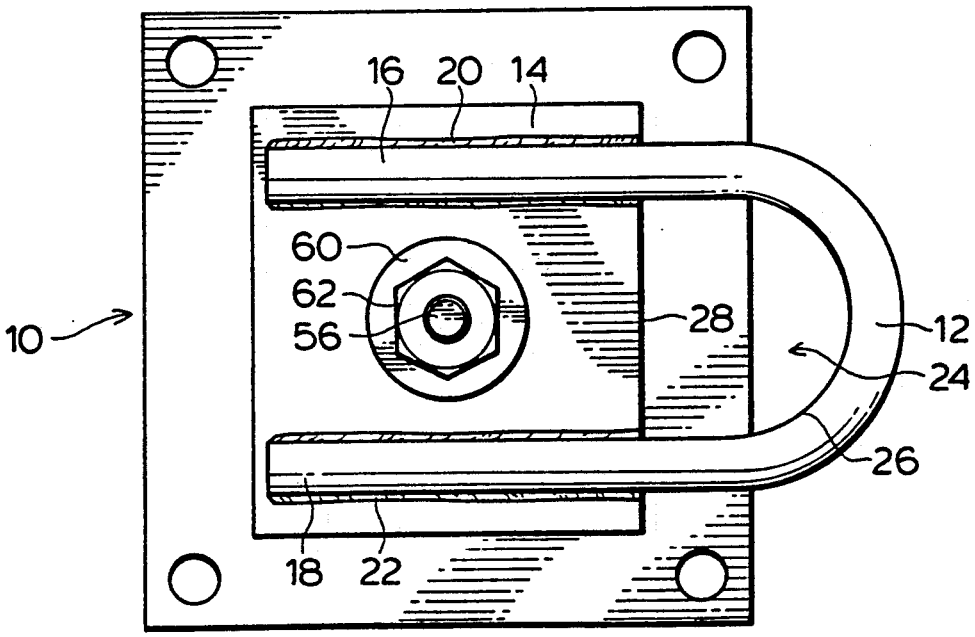
FIG. 2 is a top plan view of the safety anchor of FIG. 1.
Figure 3:
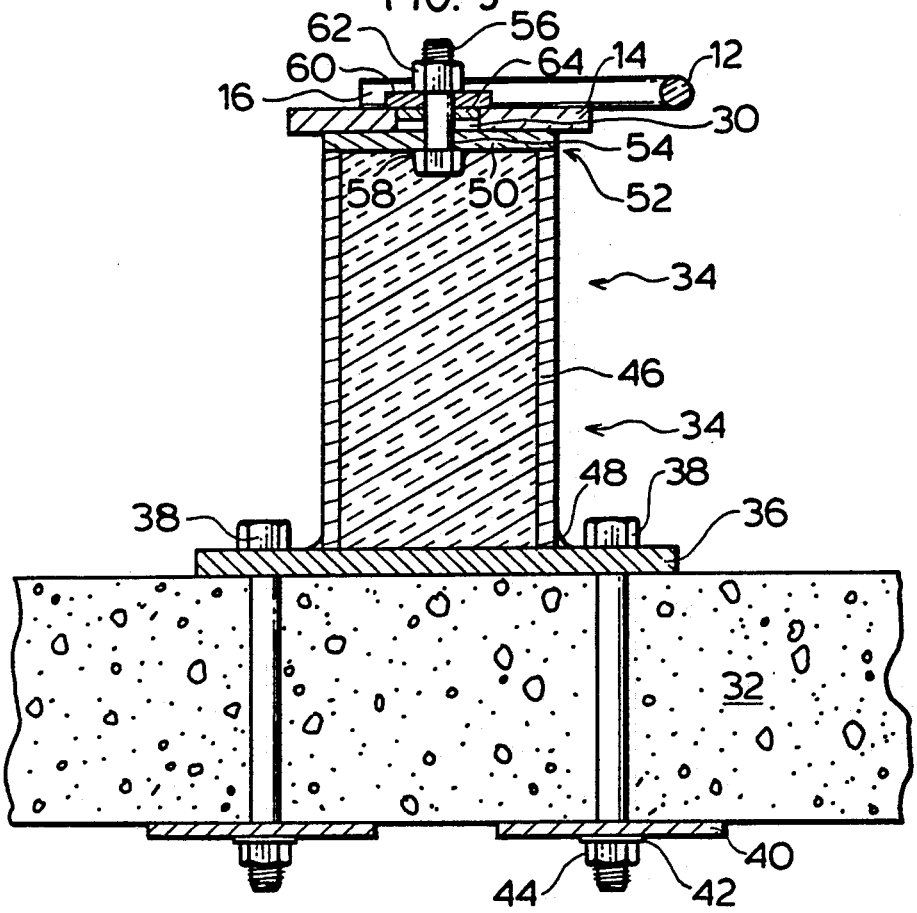
FIG. 3 is a side elevation view in cross section of the safety anchor of FIG. 1 attached to a roof.

A preferred embodiment of the safety anchor of the present invention is shown in FIGS. 1, 2 and 3 generally indicated at 10. Safety anchor 10 has a U-shaped anchor member 12 attached to a base 14. Anchor member 12 is typically formed of ¾ inch bar stock bent into the appropriate shape. In order to reduce the possibility of chafing of the safety ropes, the anchor member 12 is preferably formed from round bar stock. Anchor member 12 has arms 16 and 18 in contact with the top surface of the base 14 substantially across the entire surface of the base 14. Arms 16 and 18 are secured to the surface of the base 14 by welds 20 and 22 between the peripheries of the arms 16 and 18 and the surface of the base 14. Anchor member 12 has a closed loop 24 extending from the base 14 for attachment of the safety ropes. The closed loop is defined by the interior periphery 26 of the anchor member 12 extending beyond the base 14 and the exterior periphery 28 of the base 14 between arms 16 and 18 of the anchor member 12.

For use of the safety anchor on existing buildings a support means is normally provided attached to the roof to raise the safety anchor above the roof surface and to which the safety anchor is attached. Such a support means is indicated in the figures by numeral 34. Support means 34 has a base 36 which rests on the upper surface of the roof 32 and is bolted securely to the roof 32 by means of bolts 38 which extend through holes drilled through the roof 32. To the ends of bolts 38 are attached plates 40, lockwashers 42 and nuts 44.

Attached to the base 36 is a generally cylindrical hollow support housing 46 which is welded to base 36 at its lower end by weld 48 and has a plate 50 attached at its upper end by weld 52. Plate 50 is provided with a central hole 54 through which a bolt 56 is inserted and preferably attached to plate 50 by weld 58. A central hole 30 is provided in the base 14 of safety anchor 10 for attachment of the safety anchor 10 to the support means 34 by means of bolt 56. The central hole 30 of the base 14 is aligned with bolt 56 and thereafter washer 60 and nut 62 placed on the bolt and nut 62 tightened down to attach the base 14 to the support housing 34.

For new building construction, a suitable raised platform can be provided during forming of the roof to raise the safety anchor above the roof surface. The safety anchor is attached to the raised platform in a manner similar to its attachment to the support means.

Layers of insulation and moisture proof sealing are applied in the typical fashion to the roof and support means to ensure that the roof remains water tight.

The embodiment of the safety anchor 10 illustrated in FIGS. 1, 2 and 3 is provided with means for allowing swiveling of the base 14 and the attached anchor member 12 to bring the closed loop 24 into any desired position for attachment of a safety rope. This means is provided for by the enlargement of hole 30 in the base and provision of a spacer 64 which is inserted in hole 30 between the washer 60 and the top plate 50.

Figure 4:
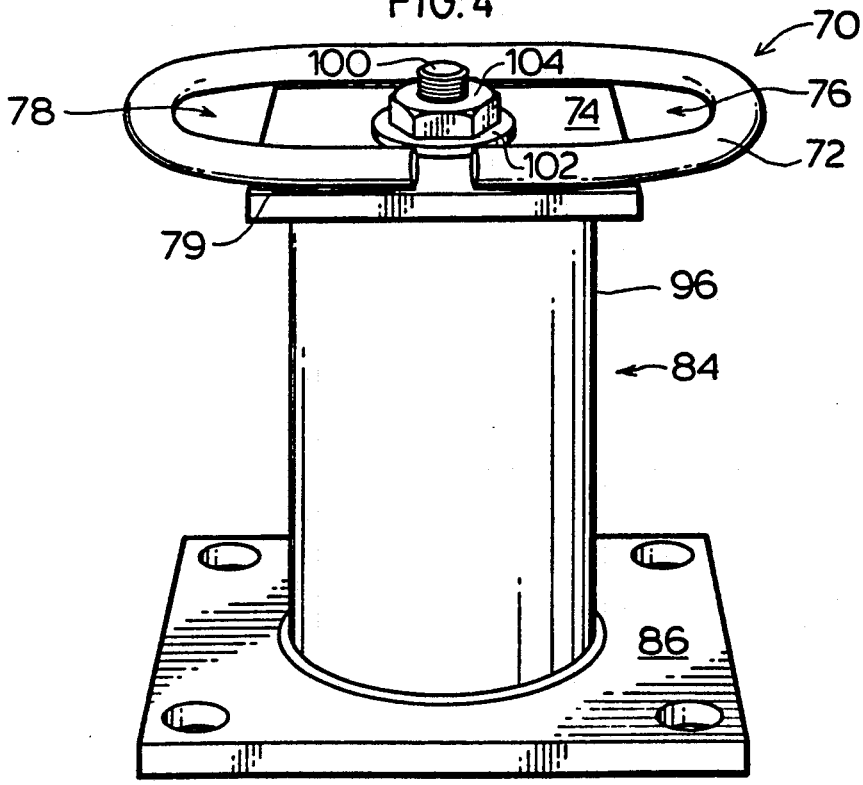
FIG. 4 is a perspective view of a second embodiment of the safety anchor.
Figure 5:
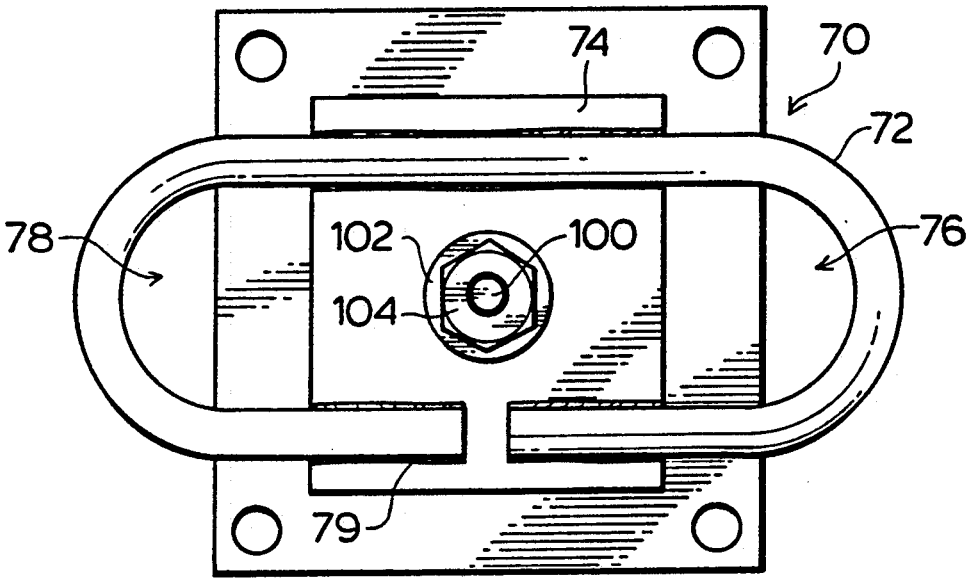
FIG. 5 is a top plan view of the safety anchor of FIG. 4.
Figure 6:
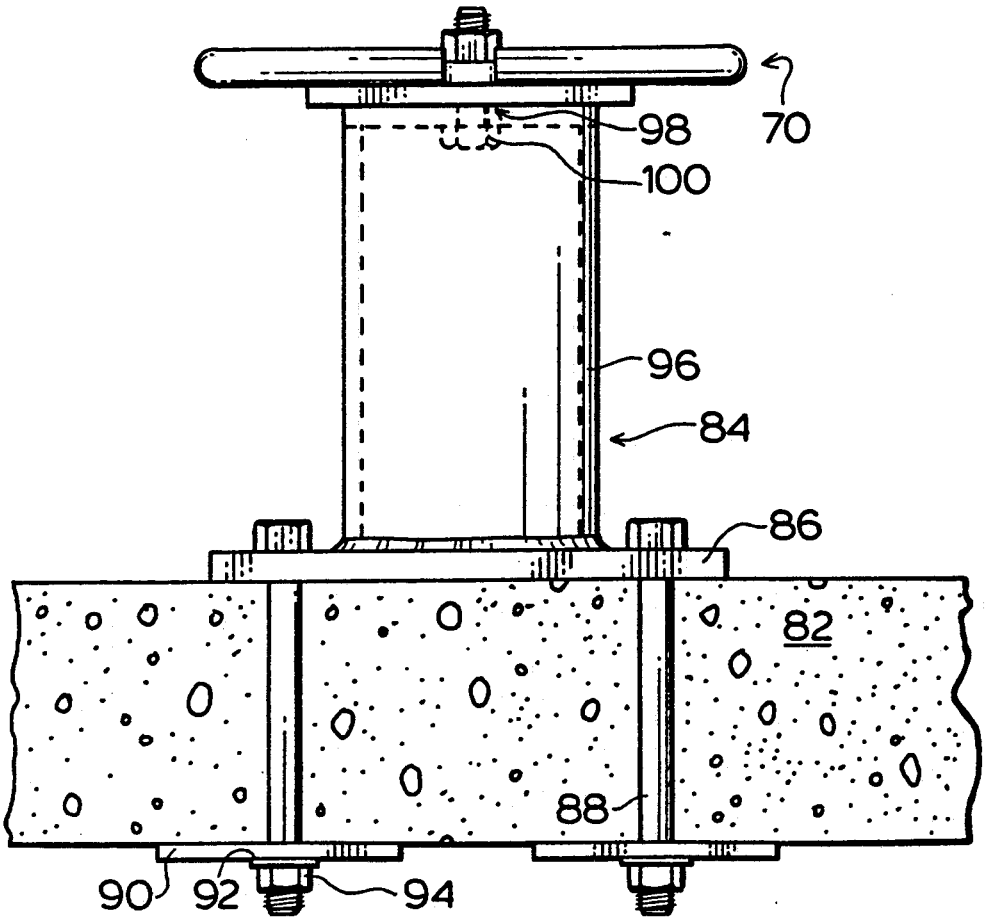
FIG. 6 is a side elevation in cross section of the safety anchor of FIG. 4 attached to a roof.

FIGS. 4, 5 and 6 show a second embodiment of the safety anchor of the present invention generally indicated at 70. The safety anchor has a C-shaped anchor member 72 attached to base 74. The C-shaped anchor member 72 is attached such that two closed loops 76 and 78 are provided to opposite sides of the base 74. The means of attachment of the anchor member 72 to the base 74 is by welds 79 similar to that of the first embodiment above.

FIG. 6 illustrates safety anchor 70 attached to a roof 82 by means of a support means shown at 84. The support means is identical to that of the first embodiment including a base 86 bolted securely to the roof 82 by means of bolts 88 extending through holes drilled in the roof 82. Base 86 is securely held to the roof by means of compression plates 90, washers 92 and nuts 94. Attached to the surface of the base 86 is a generally cylindrical hollow support housing 96. The support housing and its top is provided with a central hole 98 through which bolt 100 is inserted and attached to the top of the support housing 96. The safety anchor 70 is attached to the bolt 100 by means of a washer 102 and nut 104.

Figure 7:
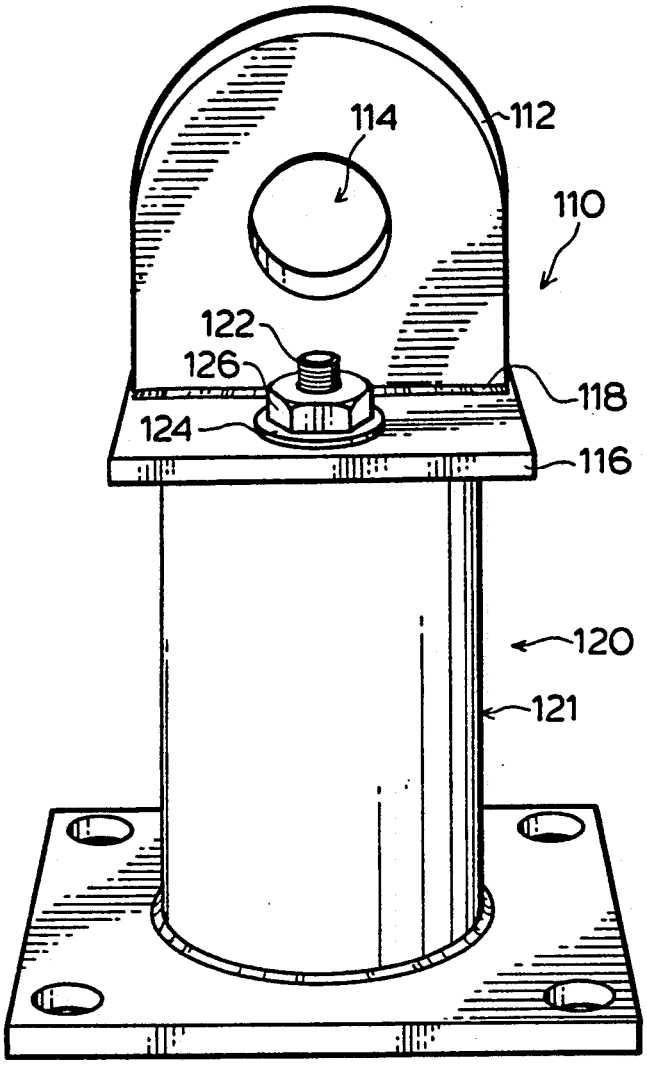
FIG. 7 is a perspective view of third embodiment of the safety anchor.

Another embodiment of the safety anchor of the present invention is shown in FIG. 7 generally indicated at 110. Safety anchor 110 has an anchor member 112 comprising an upright plate with a central hole 114 for attachment of the safety rope. In order to prevent chafing of the rope the exterior periphery of the top of anchor member 112 is rounded and all of the edges of the top surface and hole 114 are bevelled. Plate 112 is provided with an elongated bottom surface which is securely attached to base 116 by weld 118. Safety anchor 110 is attached to support means 120 by bolts 122 which extend from support housing 121 through holes provided in the base 116 on opposite sides of the anchor member 112. Washers 124 and nuts 126 are provided for securing the anchor member 110 to support means 120. Other details of the support means 120 including the attachment to the roof are as shown in FIGS. 3 and 6 with respect to the other embodiments.

Figure 8:
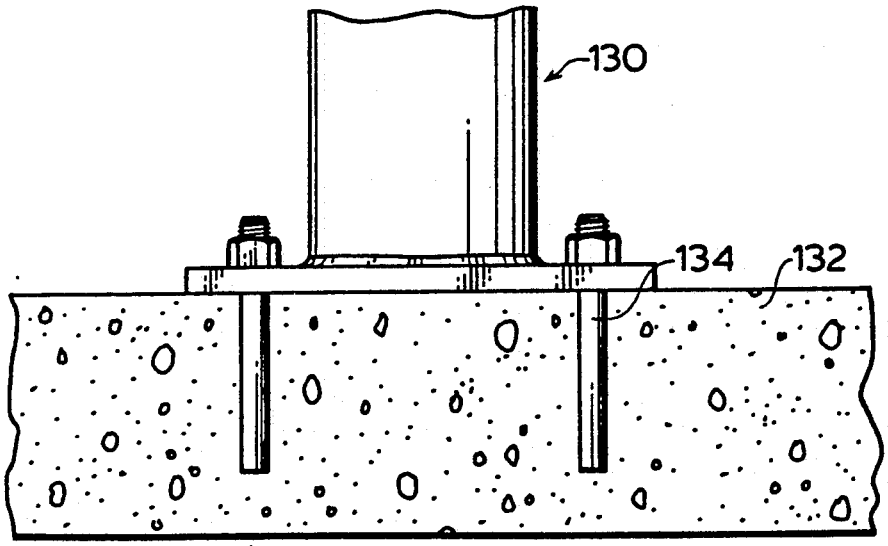
FIG. 8 is a side elevation view in cross section of a second embodiment of the support means attached to the roof.

FIG. 8 illustrates an alternative means of attaching the support means 130 to a roof 132. This method of attachment is used when it is not possible to extend bolts completely through the roof 132 as for example if the area of the underside of the roof through which the bolt would extend is inaccessible. In such situations, holes are drilled into the roof 132 and suitable adhesive or expanding connectors, preferably adhesive connectors 134 are utilized to securely attach support means 130 to the roof 132.

The anchor member of the present invention resists a tensile force of at least 5000 pounds without separation from the plate preferably at least about 8,000 pounds, more preferably, at least about 10,000 pounds.

The anchor member and base plate are manufactured from a suitable material which will be minimally affected by the environmental forces to which it will be subjected in use. Preferably, the anchor member will be manufactured from stainless steel to minimize the potential for corrosion of the safety anchor. Similarly, the bolts, washers and nuts which attach the safety anchor to the support means are also preferably constructed of stainless steel. The support means is typically manufactured from galvanized steel.

While all of the above embodiments have been shown as having the anchor member welded to the base plate, it should be appreciated that the safety anchors and particularly the safety anchor of the third embodiment may also be formed in one piece, for example by casting or forging.

The safety anchor of the present invention has an anchor member which is provided with an elongate securing member (e.g. the arms of the anchor members of the first and second embodiments and the elongated bottom surface of the third embodiment) in contact with a surface of the base. The anchor member is attached to the base by a plurality of points of attachment, preferably a continuous weld between the elongate securing member and the surface of the base. It is the provision of this elongated attachment of the anchor member to the base which provides the safety anchor of the present invention with its advantages.

It will now be seen how the safety anchor of the present invention provides for a secure safe means for attachment of safety ropes, the elongate securing member of the anchor member resulting in the safety anchor having high tensile strength and high resistance to lateral and shear forces.

Although various preferred embodiments of the present invention have been described herein in detail it will be appreciated by those of skill in the art that variations may be made thereto without departing from the spirit of the invention or the scope of the appended claims.

The embodiments of the invention in which an exclusive property or privilege is claimed are as follows:

1. A safety anchor for mounting on the roof of a building comprising an anchor member;

a base supporting said anchor member;

said anchor member being a C shaped bar having two closed loops extending to either side of said base, and an elongate securing member defined by the portion of said anchor member in contact with said base, said closed loops being defined by the interior periphery of the portion of said anchor member extending from said base and the exterior periphery of the base between the portion of said anchor member in contact with the surface of said base, said anchor member being attached to said base by a plurality of points of attachment between said elongate securing member and said surface of said base extending substantially and continuously across said surface of said base, said plurality of points of attachment being provided by a continuous weld between said portion of said anchor in contact with said base and said surface of said base.

2. A safety anchor as claimed in claim 1 further comprising a support means adapted to raise the safety anchor above the roof surface.

3. A safety anchor as claimed in claim 2 wherein said support means comprises a base for attachment to the roof and a support housing between the base of said support means and the base for support of said anchor member.

4. A safety anchor as claimed in claim 3 wherein said base of said support means is adapted to attach directly to the roof and said base for support of said anchor member is swivably attached to said support housing.

5. A safety anchor for mounting on the roof of a building comprising:

a U shaped anchor member securely attached to a base by a plurality of points of attachment between the arms of said anchor member and a surface of said base;

said anchor member having a closed loop extending from said base, said loop being defined by the interior periphery of the portion of said anchor member extending from said base and the exterior periphery of the base between the arms of said anchor member a support means adapted to raise the safety anchor above the roof surface, said support means comprising a base for attachment to the roof and a support housing between the base of said support means and said base for support of said anchor member for support said anchor member.

6. A safety anchor as claimed in claim 5 wherein said base for support of said anchor member is swivably attached to said support housing.

7. A safety anchor for mounting on the roof of a building comprising an anchor member a base supporting said anchor member said anchor member being a C shaped bar having two closed loops extending to either side of said base and an elongate securing member defined by the portion of said anchor member in contact with said base, said closed loops being defined by the interior periphery of the portion of said anchor member extending from said base and the exterior periphery of the base between the portion of said anchor members in contact with surface of said base said anchor member being attached to said base by means of a plurality of points of attachment between said elongate securing member and said surface of said base, said plurality of points of attachment extending substantially across said surface of said base.

8. A safety anchor as claimed in claim 7 further comprising a support means adapted to raise the safety anchor above the roof surface.

9. A safety anchor as claimed in claim 8 wherein said support means comprises a base for attachment to the roof and a support housing between the bases that support means and the base for support of said anchor member.

10. A safety anchor as claimed in claim 9 wherein said base of said support means is adapted to attach directly to the roof and said base for support of said anchor member is swivably attached to said support housing.

* * * * *